US012667216B2

(12) United States Patent
Gebhardt et al.

(10) Patent No.: US 12,667,216 B2
(45) Date of Patent: Jun. 30, 2026

(54) CURTAIN SUPPORT RAIL CONNECTOR

(71) Applicant: InPro Corporation, Muskego,, WI (US)

(72) Inventors: David R. Gebhardt, Milwaukee, WI (US); Emma Elizabeth Moratti, Franklin, WI (US)

(73) Assignee: InPro Corporation, Muskego, WI (US)

( * ) Notice: Subject to any disclaimer, the term of this patent is extended or adjusted under 35 U.S.C. 154(b) by 29 days.

(21) Appl. No.: 18/904,716

(22) Filed: Oct. 2, 2024

(65) Prior Publication Data

US 2026/0090672 A1 Apr. 2, 2026

(51) Int. Cl.

| | |
|---|---|
| ***A47H 15/00*** | (2006.01) |
| ***A47H 1/04*** | (2006.01) |
| ***A47H 15/02*** | (2006.01) |

(52) U.S. Cl.

CPC ..... *A47H 15/02* (2013.01); *A47H 1/04* (2013.01)

(58) Field of Classification Search

CPC ..... E05D 15/0621; E05D 15/0604; E05D 15/0608; E05D 15/0652; E05D 15/10; E05D 15/1042; E05D 15/26; E05D 15/266; E05D 2015/1005; E05F 1/16; E05F 3/06; E05F 3/18; E05F 5/003; E05Y 2201/212; E05Y 2201/412; E05Y 2201/684; E05Y 2600/314; E05Y 2900/20; E05Y 2900/212; E06B 3/4762; A47B 61/00; A47B 77/08

See application file for complete search history.

(56) References Cited

U.S. PATENT DOCUMENTS

| | | | |
|---|---|---|---|
| 2,317,531 A | 4/1943 | Leslie et al. | |
| 2,405,020 A | 7/1946 | Deirking | |
| 2,528,848 A | 11/1950 | Weinzimmer | |

(Continued)

FOREIGN PATENT DOCUMENTS

| | | | |
|---|---|---|---|
| DE | 102019121404 A1 * | 2/2021 | ..... E05D 15/0652 |
| EP | 1013865 A2 * | 6/2000 | ..... E06B 3/972 |

(Continued)

OTHER PUBLICATIONS

Bendable Track Heavy Duty T1. Archived Copy from Oct. 16, 2008 of Online Catalog [online]. Konnect International [retrieved on Apr. 9, 2011]. Retrieved from the Internet: <URL:http://web.archive.org/web/20081016075741/http://www.konnectinternational.com/app/stx.products.asp?cid= 1>.

(Continued)

*Primary Examiner* — Chuck Y Mah

(74) *Attorney, Agent, or Firm* — Reinhart Boerner Van Deuren s.c.

(57) ABSTRACT

A curtain support assembly is provided. The curtain support assembly includes a first rail, a second rail, and a connector. The first and second rails each include slide surfaces for supporting a curtain carrier moving along a curtain travel path. The connector includes a first end connected to the first rail and a second end connected to the second rail such that the first and second rails are separated from each other by a gap having a predefined distance. The connector further includes a ramp having a length greater than the predefined distance. The connector is configured such that a curtain carrier moving along the curtain travel path from the first rail to the second rail is supported by the ramp.

23 Claims, 8 Drawing Sheets

(56) References Cited

U.S. PATENT DOCUMENTS

| | | | | | |
|---|---|---|---|---|---|
| 2,597,224 | A | | 5/1952 | Charron et al. | |
| 3,620,284 | A | * | 11/1971 | Shayman | A47H 5/0325 160/331 |
| 3,729,868 | A | * | 5/1973 | Burum | E05D 15/0669 160/381 |
| 4,014,071 | A | | 3/1977 | Janson | |
| 4,102,008 | A | | 7/1978 | Janson | |
| 4,134,177 | A | | 1/1979 | Janson | |
| 4,306,332 | A | | 12/1981 | Simmons | |
| 4,336,757 | A | | 6/1982 | Toder | |
| 4,524,698 | A | | 6/1985 | Tourtellier et al. | |
| 4,694,531 | A | | 9/1987 | Foy | |
| 4,793,399 | A | | 12/1988 | Pryor | |
| 4,796,684 | A | | 1/1989 | Haimovitz | |
| 5,115,056 | A | | 5/1992 | Schmutte | |
| D337,493 | S | | 7/1993 | King | |
| 5,335,890 | A | | 8/1994 | Pryor et al. | |
| 5,421,059 | A | | 6/1995 | Leffers, Jr. | |
| 5,509,713 | A | | 4/1996 | Hou | |
| 6,003,201 | A | * | 12/1999 | Ryczek | E05D 13/04 16/DIG. 20 |
| 6,173,753 | B1 | | 1/2001 | Laster-Bivens et al. | |
| 6,409,415 | B1 | | 6/2002 | Toder | |
| 7,043,795 | B2 | * | 5/2006 | Bosgoed | A47H 1/04 16/95 D |
| D541,094 | S | | 4/2007 | Yu et al. | |
| D542,067 | S | | 5/2007 | Watkins et al. | |
| D552,396 | S | | 10/2007 | Balenzano | |
| D595,078 | S | | 6/2009 | Kollman et al. | |
| D595,984 | S | | 7/2009 | Kollman et al. | |
| D606,793 | S | | 12/2009 | Allsopp | |
| 7,653,966 | B2 | | 2/2010 | Quinn et al. | |
| 7,735,189 | B2 | | 6/2010 | Richardson | |
| D633,742 | S | | 3/2011 | Ng | |
| D638,645 | S | | 5/2011 | Barnes et al. | |
| D661,533 | S | | 6/2012 | Bennett et al. | |
| 8,240,354 | B2 | | 8/2012 | Coleman et al. | |
| 8,533,910 | B2 | | 9/2013 | Bennett et al. | |
| 2007/0277944 | A1 | | 12/2007 | Wu | |
| 2008/0310911 | A1 | * | 12/2008 | Jones | F16B 7/042 403/309 |
| 2011/0061819 | A1 | | 3/2011 | Elinson | |
| 2012/0174449 | A1 | * | 7/2012 | Pitcher | G09F 1/12 40/606.01 |
| 2014/0102017 | A1 | * | 4/2014 | Booi | E06B 1/56 52/204.1 |
| 2020/0048946 | A1 | * | 2/2020 | Blum | E05D 15/26 |
| 2023/0272652 | A1 | * | 8/2023 | Prison | E05D 15/1047 49/213 |
| 2024/0240503 | A1 | * | 7/2024 | Fukada | E05D 15/10 |

FOREIGN PATENT DOCUMENTS

| | | | | | |
|---|---|---|---|---|---|
| FR | 2235664 | A1 | * | 8/2021 | B60J 7/024 |
| GB | 1457399 | A | * | 12/1976 | E01B 25/24 |
| JP | 3176264 | U | * | 6/2012 | |
| JP | 2014083016 | A | * | 5/2014 | |
| JP | 2025025441 | A | * | 2/2025 | |

OTHER PUBLICATIONS

Product Cut Sheet: I-Series Cubicle Curtain Track System. Product Sheet [online]. Mariak Contract [retrieved on Mar. 14, 2011]. Retrieved from the Internet: <URL:http://www.mariak.com/images/pdf/cubicle_curtain/CT%20Spec%20Cut%20Sheet%20l-Series.pdf>.

Cubicle Curtain Tracks. Online Catalog [online]. Mariak Contract [retrieved on Mar. 14, 2011]. Retrieved from the Internet: <URL:http://www.mariak.com/index.php?option=com_content&view=article&id=53>.

Bendable Track. Online Catalog [online]. Konnect International [retrieved on Mar. 14, 2011]. Retrieved from the Internet: <URL:http://www.konnectinternational.com/app/stx.products.asp?cid= 1>.

T-Bar Application. Online Catalog [online]. Konnect International [retrieved on Mar. 14, 2011]. Retrieved from the Internet: <URL:http://www.konnectinternational.com/app/stx.products.asp?cid= 16>.

Roller. Online Catalog [online]. Konnect International [retrieved on Mar. 14, 2011]. Retrieved from the Internet: <URL:http://www.konnectinternational.com/app/stx.products.asp?cid=2>.

Ceiling Mount Cartridge. Online Catalog [online]. Konnect International [retrieved on Mar. 14, 2011]. Retrieved from the Internet: <URL:http://www.konnectinternational.com/app/stx.products.asp?cid=4>.

Assembly Photo. Online Catalog [online]. Konnect International [retrieved on Mar. 14, 2011]. Retrieved from the Internet: <URL:http://www.konnectinternational.com/app/stx.products.asp?cid=19>.

Aluglide Bendable Track. Online Catalog [online]. Tracks & poles & things [retrieved on Mar. 14, 2011]. Retrieved from the Internet: <URL:http://www.tracksandpoles.com/track_set.shtml#>.

Nylon Wheel Carrier With Brass Ring. Online Catalog [online]. Sailbrite [retrieved on Mar. 14, 2011]. Retrieved from the Internet: <URL:http://www.sailrite.com/RECMAR-4121-Nylon-Wheel-Carrier-With-Brass-Ring-Pk14>.

Nylon Block Carrier. Online Catalog [online]. Sailbrite [retrieved on Mar. 14, 2011]. Retrieved from the Internet: <URL:http://www.sailrite.com/RECMAR-3312-Nylon-Block-Carrier>.

Bendable I Beam Curtain Track Aluminum 48" Long. Online Catalog [online]. Sailbrite [retrieved on Mar. 14, 2011]. Retrieved from the Internet: <URL:http://www.sailrite.com/RECMAR-4108-Bendable-I-Beam-Curtain-Track-Aluminum-48-Long>.

Formatrac Bendable Cubicle Track, InPro Corporation [retrieved on Oct. 2, 2024]. Retrieved from the Internet: <URL: https://www.inprocorp.com/products/privacy-systems/cubicle-curtain-track-and-accessories/formatrac-bendable-cubicle-track/ >.

Formatrac Carrier with Hook, InPro Corporation [retrieved on Oct. 2, 2024]. Retrieved from the Internet: <URL: https://www.inprocorp.com/products/privacy-systems/cubicle-curtain-track-and-accessories/carrier-with-hook/ >.

Formatrac End Cap, InPro Corporation [retrieved on Oct. 2, 2024]. Retrieved from the Internet: <URL: https://www.inproproducts.com/products/privacy-systems/cubicle-curtain-track-and-accessories/formatrac-end-cap/ >.

Formatrac Spring Clip with Grid Clip, InPro Corporation [retrieved on Oct. 2, 2024]. Retrieved from the Internet: <URL: https://www.inprocorp.com/products/privacy-systems/cubicle-curtain-track-and-accessories/spring-clip-with-grid-clip/ >.

Formatrac Spring Clip, InPro Corporation [retrieved on Oct. 2, 2024]. Retrieved from the Internet: <URL: https://www.inprocorp.com/products/privacy-systems/cubicle-curtain-track-and-accessories/formatrac-spring-clip/ >.

Formatrac Fixed End Cap, InPro Corporation [retrieved on Oct. 2, 2024]. Retrieved from the Internet: <URL: https://www.inprocorp.com/products/privacy-systems/cubicle-curtain-track-and-accessories/fixed-end-cap/ >.

Formatrac Swivel End Cap, InPro Corporation [retrieved on Oct. 2, 2024]. Retrieved from the Internet: <URL: https://www.inprocorp.com/products/privacy-systems/cubicle-curtain-track-and-accessories/formatrac-swivel-end-cap/ >.

Formatrac Radius Clip, InPro Corporation [retrieved on Oct. 2, 2024]. Retrieved from the Internet: <URL: https://www.inprocorp.com/products/privacy-systems/cubicle-curtain-track-and-accessories/formatrac-radius-clip/ >.

Adjustable Drop Chain, InPro Corporation [retrieved on Oct. 2, 2024]. Retrieved from the Internet: <URL: https://www.inprocorp.com/products/privacy-systems/cubicle-curtain-track-and-accessories/adjustable-drop-chain/ >.

* cited by examiner

CURTAIN SUPPORT RAIL CONNECTOR

BACKGROUND OF THE INVENTION

The present invention relates generally to the field of curtain support structures. The present invention relates specifically to a curtain support rail connector configured to join two curtain support rails.

SUMMARY OF THE INVENTION

One embodiment of the invention relates to a curtain support rail connector for connecting curtain support rails. Each curtain support rail has first and second ends and each includes slide surface for supporting a curtain carrier moving along a curtain travel path. The curtain support rail connector includes a first end, a second end, and a ramp. The first end has at least one flange configured to connect to the first end of a first curtain support rail. The second end is positioned opposite the first end and includes at least one flange configured to connect to the second end of a second curtain support rail. When connected to the connector, the slide surfaces of the first curtain support rail and the second curtain support rail are aligned, and the first curtain support rail and the second curtain support rail are separated by a gap that has a predefined distance. The ramp has a length greater than the predefined distance. The ramp includes a first angled portion for located adjacent to the slide surface of the first curtain support rail, a center portion for located adjacent to the gap, and a second angled portion for locating adjacent to the slide surface of the second curtain support rail. As such, a curtain carrier is supported by the ramp when moving along the curtain travel path from the first curtain support rail to the second curtain support rail.

Another embodiment of the invention relates to a curtain support rail connector for connecting curtain support rails. The connector includes a body, a first flange, a second flange, and a ramp. The body has a first end, a second end opposite the first end, and a first side surface extending between the first end and the second end. The first flange extends away from the first end of the body and is configured to connect to a first curtain support rail. The second flange extends away from the second end of the body and is configured to connect to a second curtain support rail. When connected to the connector the first curtain support rail and the second curtain support rail are separated by a gap that has a predefined distance defined by the body. The ramp has a length greater than the predefined distance. The connector further includes a gap surface that extends between an inner surface of the ramp and the first side surface of the body. As such, the gap surface, the inner surface of the ramp, and the first side surface define a groove. When a curtain carrier moves between the first curtain support rail and the second curtain support rail, the curtain carrier travels along the groove and is supported by the ramp.

Another embodiment of the invention relates to a curtain support assembly. The curtain support assembly includes a first rail, a second rail, and a connector positioned between the first rail and the second rail. The first rail includes a first slide surface configured to support a curtain carrier. The second rail includes a second slide surface configured to support a curtain carrier. The connector includes a first end, a second end, and a ramp. The first end has a first flange engaged with the first curtain support rail. The second end is positioned opposite the first end and includes a second flange engaged with second curtain support rail. The second end is separated from the first end by a gap defining a predefined distance between the first sliding surface and the second sliding surface. The ramp has a length greater than the predefined distance. The ramp includes a first angled portion located adjacent to the first slide surface of the first rail, a second angled portion located adjacent to the second slide surface of the second rail, and a center portion extending between the first angled portion and the second angled portion. The center portion is located adjacent to the gap. As such, when a curtain carrier is mounted on the curtain support assembly and moving along a curtain travel path between the first rail to the second rail, the curtain carrier is supported by the ramp.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
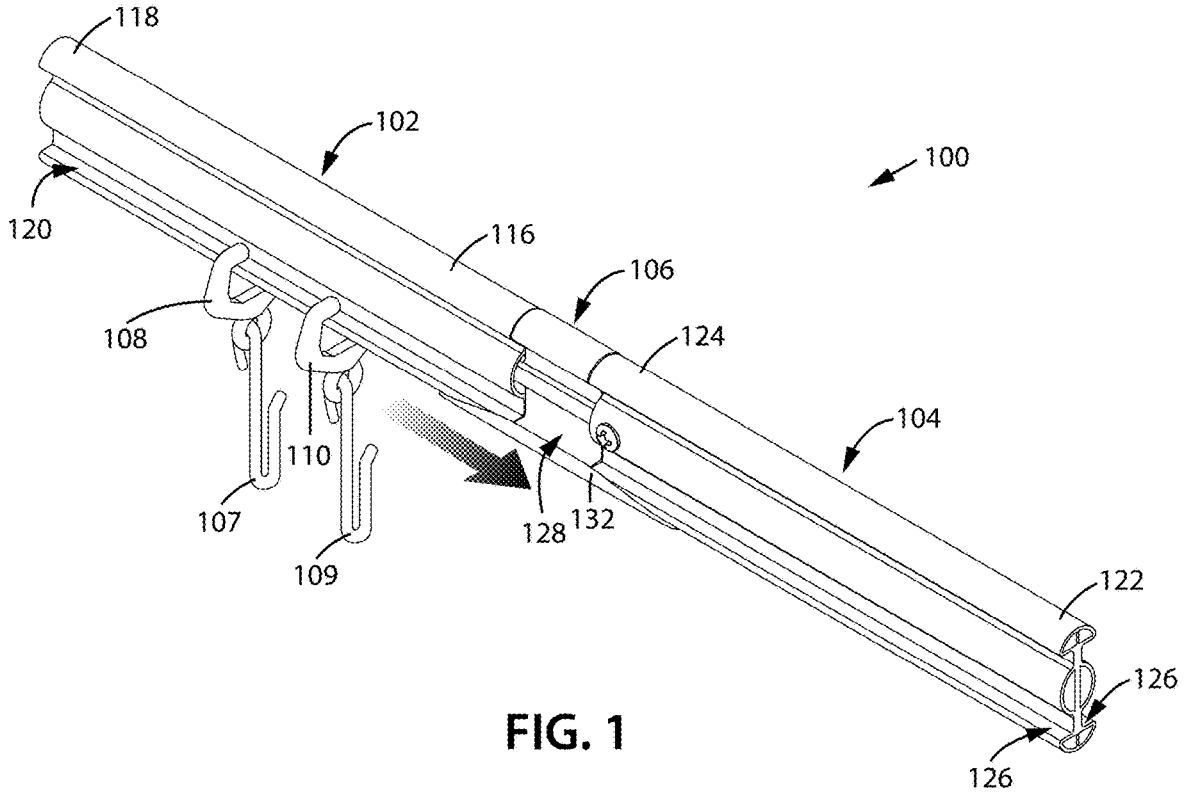
FIG. 1 is an isometric view of a curtain support assembly with curtain carriers in a first position along a curtain support rail, according to an exemplary embodiment.

Referring generally to the figures, various embodiments of a curtain support rail connector, such as connector 106, are shown. Curtain support rail connectors are configured to connect curtain support rails such that a curtain carrier may travel between adjacent curtain support rails. Applicant believes that the curtain support rail connectors discussed herein provide a transition between curtain support rails which accommodates for misalignment and twisting between such curtain support rails.

Referring to FIGS. 1-4, a curtain support assembly 100 is shown including connector 106 is shown. Curtain support assembly 100 includes:

a first curtain support rail, or first rail 102;
a second curtain support rail, or second rail 104;
a curtain support rail connector, or connector 106;
a first curtain carrier 108; and
a second curtain carrier 110.

As shown, connector 106 is positioned between first rail 102 and second rail 104. In particular, connector 106 is removably coupled to first rail 102 and second rail 102. Connector 106 includes a first end 112 configured to connect to first rail 102 and a second end 114 positioned opposite from first end 112. Second end 114 is configured to connect to second rail 104. First rail 102 includes a first end 116 and a second end 118 opposite from first end 116. First end 116 of first rail 102 is connected to first end 112 of connector 106. In certain embodiments, first end 112 of connector 106 is coupled to first end 116 of first rail 102 via a fastener, thermal bonding or an appropriate adhesive.

First rail 102 further includes at least one sliding surface 120 configured to support a curtain carrier moving along first rail 102 from first end 116 to second end 118. Specifically, first rail 102 includes two sliding surfaces 120 positioned on opposite sides of first rail 102. Sliding surfaces 120 extends along the length of first rail 102 from first end 116 to second end 118.

Second rail 104 includes a first end 122 and a second end 124 opposite from first end 122. Second end 124 of second rail 104 is connected to second end 114 of connector 106. As shown, a fastener 115 is used to couple second end 124 of second rail 104 to second end 114 of connector 106. Second rail 104 further includes at least one sliding surface 126 configured to support a curtain carrier moving along second rail 104 from first end 122 to second end 124. Specifically, second rail 104 includes two sliding surfaces 126 positioned on opposite sides of second rail 104. Sliding surfaces 126 extend along the length of second rail 104 from first end 122 to second end 124.

As shown, second rail 104 is substantially the same size and shape as first rail 102. In certain embodiments, first rail 102 and second rail 104 are made from the same material. In a certain embodiment, first rail 102 and second rail 104 are made from a thermoplastic polymer, such as acrylonitrile butadiene styrene (ABS). In other certain embodiments, first rail 102 and second rail 104 are made from a metal, such as aluminum. In other certain embodiments, first rail 102 and second rail 104 include an aluminum core with an ABS shell. In certain embodiments, first rail 102 and second rail 104 may be different materials from each other.

When connected to connector 106, slide surfaces 120 of first rail 102 and slide surfaces 126 of second rail 104 are aligned, and first rail 102 and the second rail 104 are separated by a gap 128 that has a predefined distance 130. Connector 106 includes a first ramp 132 that has a length 134 greater than the predefined distance 130.

Curtain carriers 108, 110 are configured to support a curtain in order to allow the curtain to move along a curtain travel path defined by curtain support assembly 100. As shown, curtain carrier 108 includes a hook 107 for mounting a curtain, and curtain carrier 110 includes a hook 109 for mounting a curtain.

When curtain carriers 108, 110 are mounted on curtain support assembly 100, the curtain carriers 108, 110 may move along the curtain travel path defined by curtain support assembly 100. As shown, the curtain travel path is defined by first rail 102, second rail 104, and connector 106. More specifically, the curtain travel path is defined by slide surface 120, ramp 132, and slide surface 126. As such, when curtain carriers 108, 110 move along the curtain travel path between first rail 102 and second rail 104, curtain carriers 108, 110 are supported by ramp 132.

Figure 2:
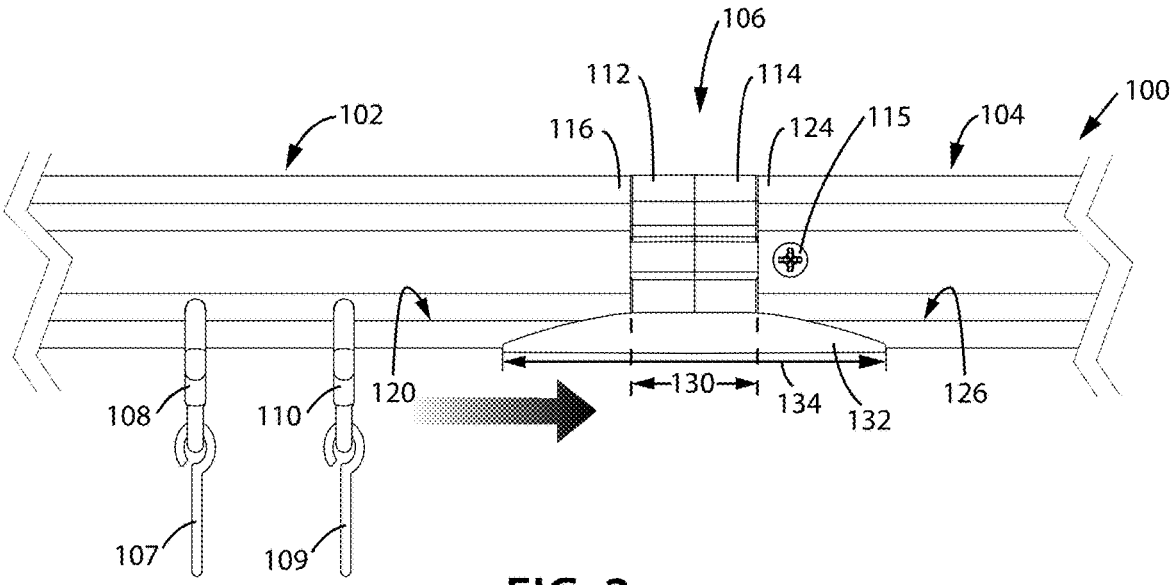
FIG. 2 is a front side view of the curtain support assembly of FIG. 1 with curtain carriers in the first position, according to an exemplary embodiment.

Referring to FIGS. 1-2, curtain support assembly 100 is shown with first curtain carrier 108 and second curtain carrier 110 in a first position along the curtain travel path such that both first curtain carrier 108 and second curtain carrier 110 are mounted on first rail 102. In particular, first curtain carrier 108 and second curtain carrier 110 are supported by slide surfaces 126.

Figure 3:
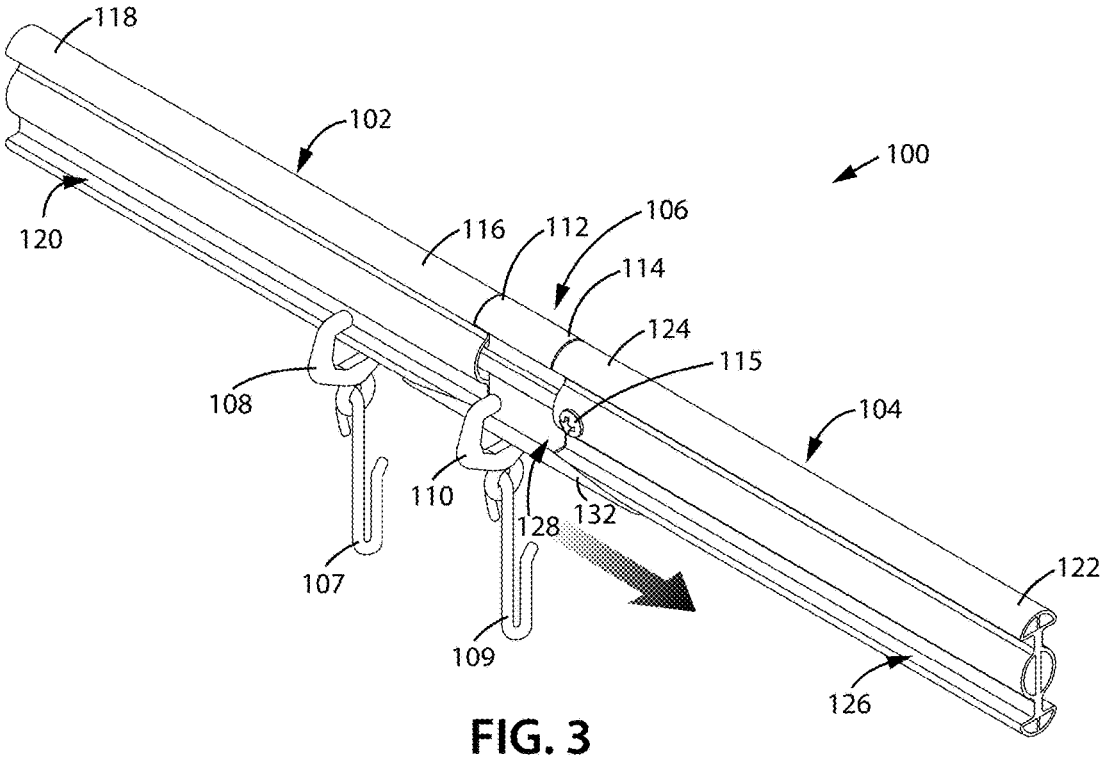
FIG. 3 is an isometric view of the curtain support assembly of FIG. 1 with curtain carriers in a second position along the curtain support rail, according to an exemplary embodiment.
Figure 4:
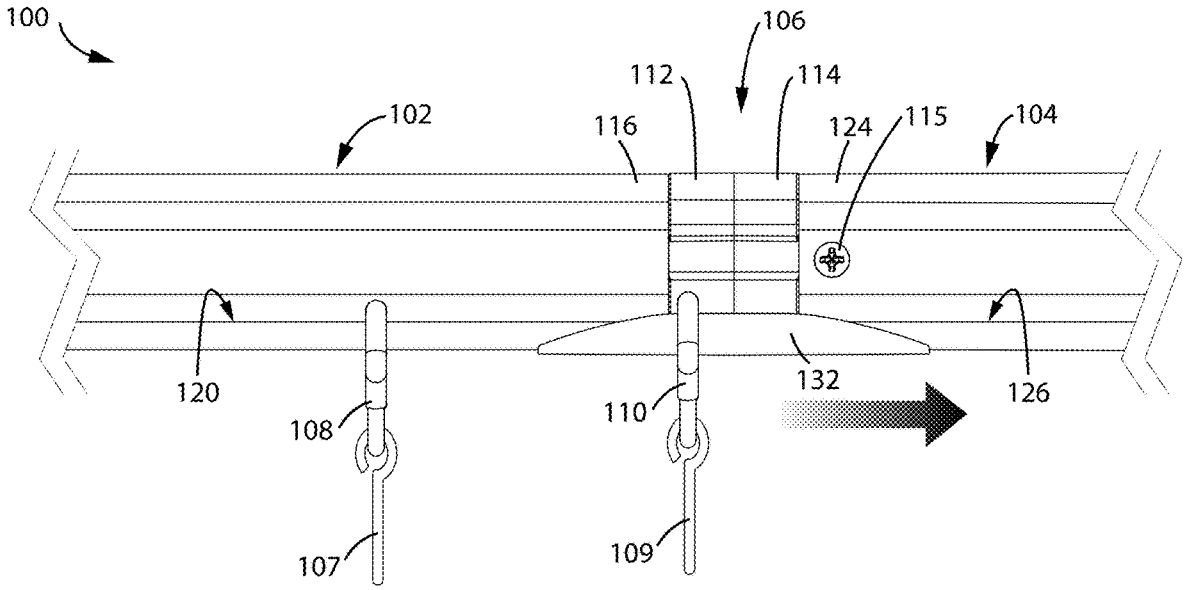
FIG. 4 is a front side view of the curtain support assembly of FIG. 1 with curtain carriers in the second position, according to an exemplary embodiment.
Figure 5:
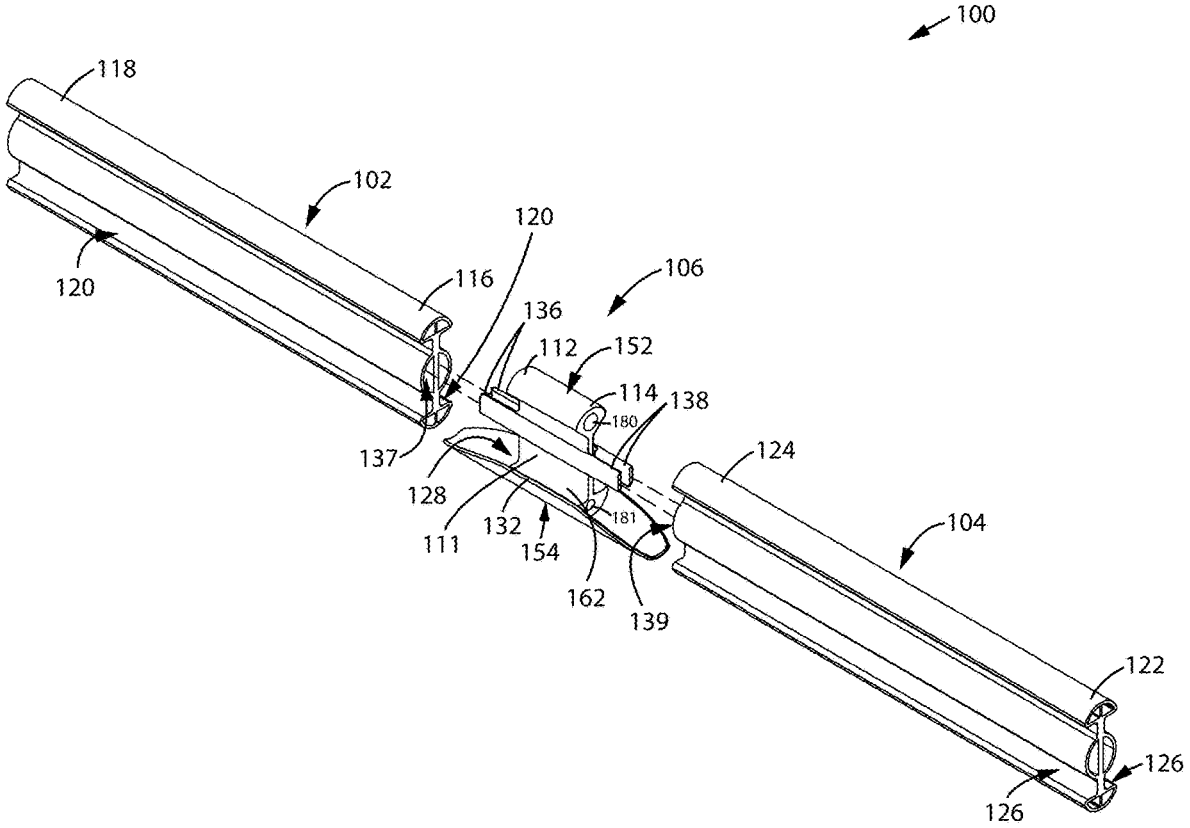
FIG. 5 is an exploded view of the curtain support assembly of FIG. 1, according to an exemplary embodiment.
Figure 6:
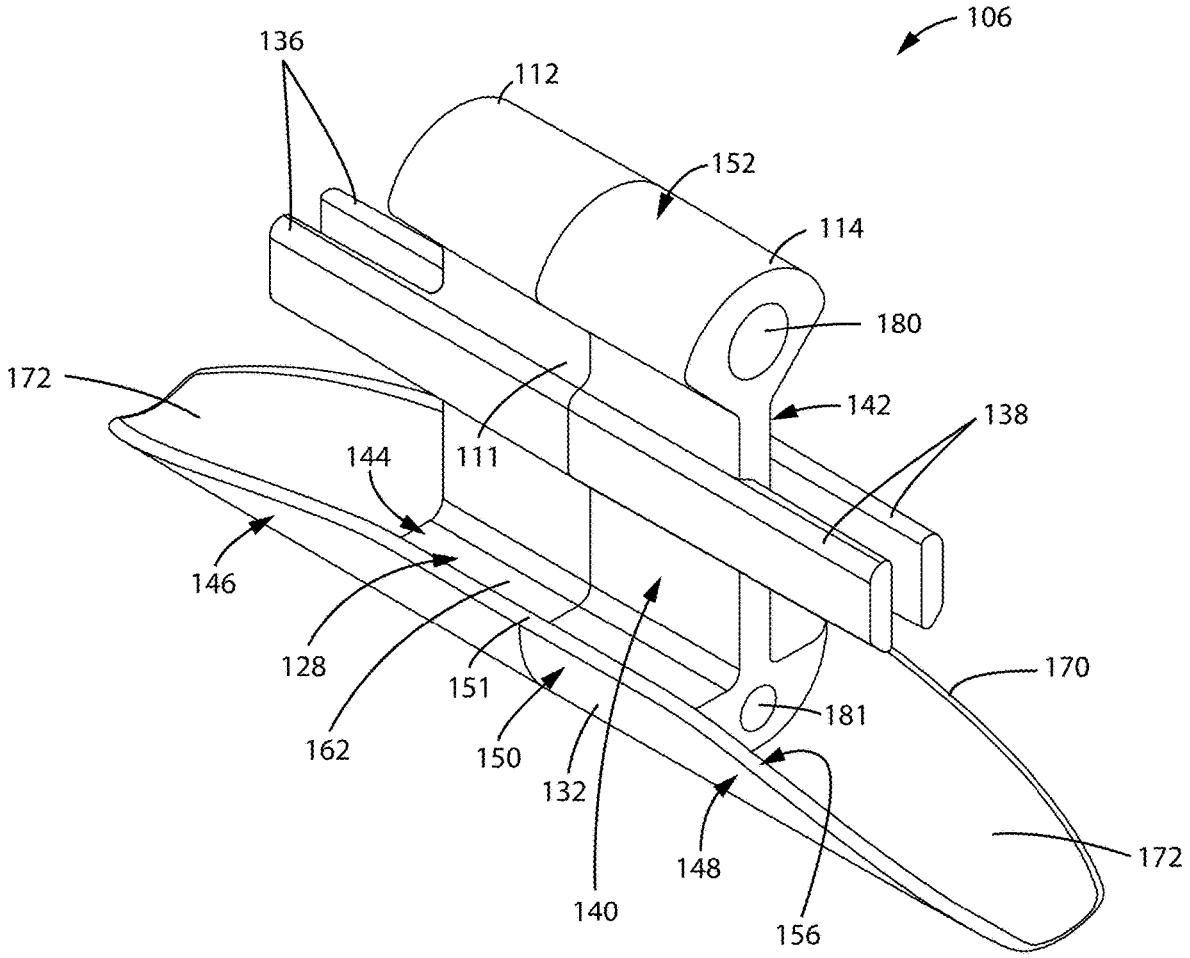
FIG. 6 is an isometric view of a curtain support rail connector of the curtain support assembly of FIG. 1, according to an exemplary embodiment.
Figure 7:
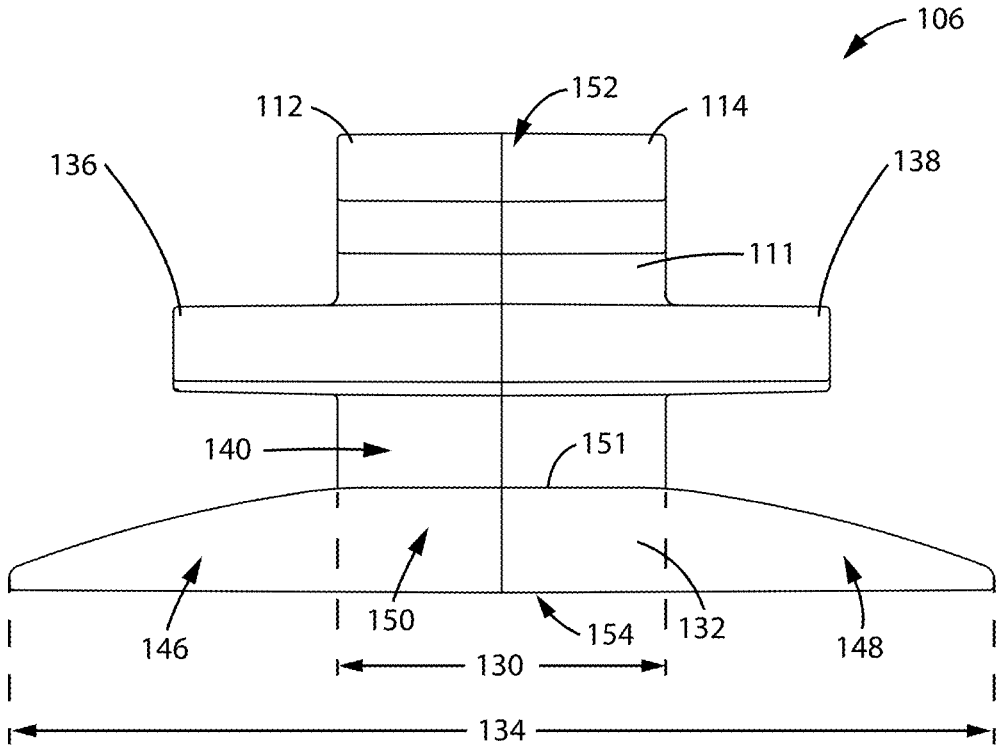
FIG. 7 is a front side plan view of the curtain support rail connector of FIG. 6, according to an exemplary embodiment.
Figure 8:
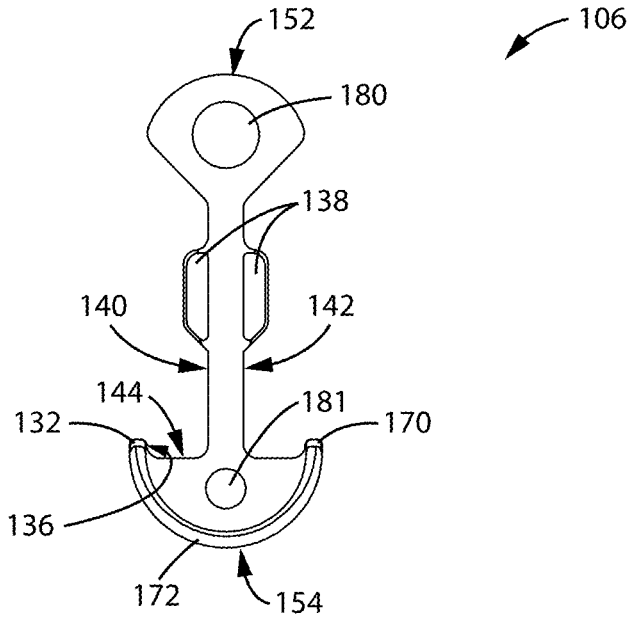
FIG. 8, is an end view of the curtain support rail connector of FIG. 6, according to an exemplary embodiment.

Referring to FIGS. 3-4, curtain support assembly 100 is shown with first curtain carrier 108 and second curtain carrier 110 in a second position along the curtain travel path. First curtain carrier 108 is mounted on first rail 102 and supported by slide surfaces 126. Second curtain carrier 110 has moved along the curtain travel path in a first direction from first rail 102 towards second rail 104. In particular, second curtain carrier 110 is supported by ramp 132.

Referring to FIGS. 5-8, connector 106 includes:

a body 111;
first end 112;
second end 114;
first ramp 132;
first flanges 136;
second flanges 138;
a first side surface 140;
a second side surface 142; and
a gap surface 144.

As shown, body 111 includes first end 112 and second end 114 opposite first end 112. First side surface 140 extends along body 111 between first end 112 and second end 114. First ramp 132 is positioned adjacent to first side surface 140. Ramp 132 includes a first angled portion 146, a second angled portion 148, and a center portion 150 extending between first angled portion 146 and second angled portion 148. First angled portion 146 is located adjacent to slide surface 120 of first rail 102. Second angled portion 148 is located adjacent to slide surface 126 of second rail 104. Center portion 150 is located adjacent to gap 128.

First angled portion 146 defines an inclined surface extending from slide surface 120 proximate to first end 116 of first rail 102 to center portion 150 of ramp 132. First angled portion 146 defines an angle between first end 116 and center portion 150. Second angled portion 148 defines an inclined surface extending from slide surface 126 proximate to second end 124 to center portion 150 of ramp 132. Second angled portion 148 defines an angle between second end 124 and center portion 150.

In a certain embodiment, an angle defined by first angled portion 146 is the same as an angled defined by second angled portion 148. In another certain embodiment, first angled portion 146 defines an angle of at least 6 degrees and at most 60 degrees. In another certain embodiment, second angled portion 148 defines an angle of at least 6 degrees and at most 60 degrees.

Ramp 132 has length 134 measured between an end of first angled portion 146 and an end of second angled portion 148. In a certain embodiment, length 134 is ½ inch to 6 inches. In another certain embodiment, length is 6 inches to 10 inches.

Center portion 150 of ramp 132 is positioned between first end 112 and second end 114 of connector 106. An outer edge 151 of center portion 150 is positioned between a top surface 152 and a bottom surface 154 of connector 106. In this way, center portion 150 is elevated above slide surface 120 and slide surface 126. In a certain embodiment, center portion 150 has a length less than predefined distance 130 of gap 128.

Body 111 and ramp 132 define gap 128. In particular, an inner surface 156 is spaced a distance from first side surface 140, and gap 128 is defined between inner surface 156 and first side surface 140. Body 111 of connector 106 further includes gap surface 144. Gap surface 144 extends between inner surface 156 of ramp 132 and first side surface 140. As shown, gap surface 144 extends along a plane that intersects with first side surface 140 of body 111 and inner surface 156 of ramp 132. In a certain embodiment, the plane is perpendicular to first side surface 140. In other certain embodiments, gap surface 144 is aligned with slide surface 120 and slide surface 126, when first rail 102 and second rail 104 are connected to connector 106.

Together, gap surface 144, inner surface 156, and ramp 132 define a groove 162. When curtain carriers 108, 110 move between first rail 102 and second rail 104, curtain carriers 108, 110 are supported by ramp 132 and travel along groove 162. Specifically, when curtain carriers 108, 110 are supported by ramp 132, curtain carriers 108, 110 are spaced a distance from gap surface 144 such that curtain carriers 108, 110 does not interface with gap surface 144. In a certain embodiment, curtain carriers 108, 110 are spaced from gap surface 144 by at least 1/16 inches. In another certain embodiment, curtain carriers 108, 110 are spaced from gap surface 144 by at most 1/4 inches.

In a certain embodiment, a length of groove 162 is equal to predefined distance 130 of gap 128. In another certain embodiment, length 134 of ramp 132 is greater than a length of groove 162.

A second ramp 170 is positioned adjacent to second side surface 142. Second side surface 142 is positioned opposite from first side surface 140 and extends along body 111 between first end 112 and second end 114. As shown, connector 106 is symmetrically about a vertical midpoint such that second ramp 170 is structured substantially the same as first ramp 132. First ramp 132 and second ramp are connected by a middle section 172. Middle section 172 extends between first ramp 132 and second ramp 170 adjacent to bottom surface 154 of body 111. When connector 106 is connected to first rail 102 and second rail 104, connector 106 interfaces with first end 116 and second end 124, respectively.

First end 112 of connector 106 includes at least one flange 136 configured to connect to first end 116 of first rail 102. As shown, two first flanges 136 extend away from first end 112 and are engaged with first rail 102. In particular, first end 116 includes at least one opening 137 configured to receive and retain a first flange 136 such that first end 116 and first end 112 are coupled together via a friction fit between flanges 136 and openings 137.

Second end 114 of connector 106 includes at least one flange 138 configured to connect to second end 124 of second rail 104. As shown, two second flanges 138 extend away from second end 114 and are engaged with second rail 104. In particular, second end 124 includes at least one opening 139 configured to receive and retain a second flange 138 such that second end 124 and second end 114 are coupled together via a friction fit between flanges 138 and openings 139.

As shown, connector 106 further includes channels 180, 181. Channels 180, 181 are formed in second end 114 of connector 106. As shown channel 180 has a larger radius than channel 181. Channels 180, 181 are configured to receive a fastener to couple connector 106 to second rail 104. In certain embodiments, channels 180, 181 are formed in first end 112 of connector. In other certain embodiments, channels 180, 181 extend from first end 112 to second end 114. In other certain embodiments, rails 102, 104 may include flanges or projections which are received and retained in channels 180, 181.

Figure 9:
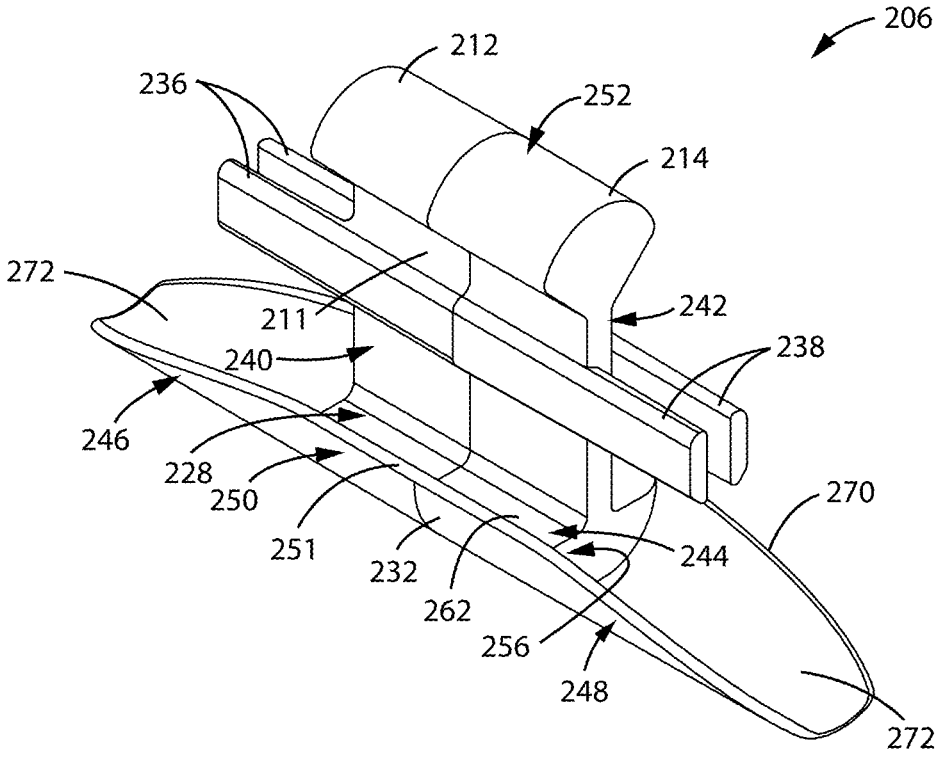
FIG. 9 is an isometric view of a curtain support rail connector, according to another exemplary embodiment.
Figure 10:
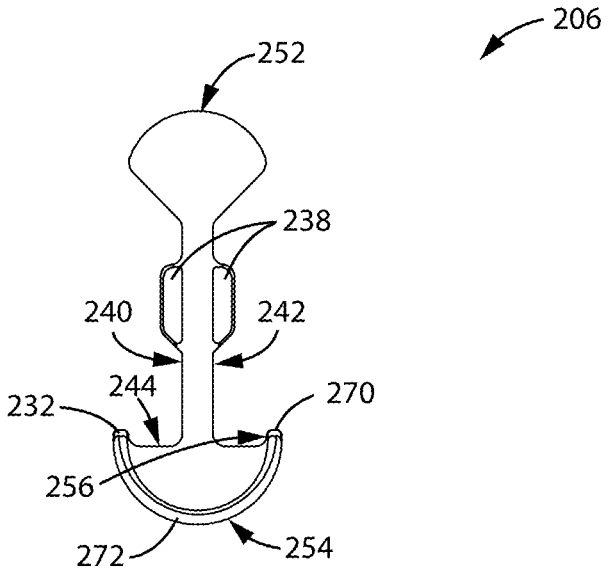
FIG. 10 is an end view of the curtain support rail connector of FIG. 9, according to an exemplary embodiment.

Referring to FIGS. 9-10, a connector 206 is shown. Connector 206 is substantially the same as connector 106, except for the differences discussed herein. Specifically, connector 206 does not include channels. First end 212 of connector 206 is configured to be coupled to a first end of a curtain support rail, such as first end 116 of first rail 102. Second end 214 of connector 206 is configured to be coupled to a second end of a curtain support rail, such as second end 124 of second rail 104. In particular, first end 212 and second end 214 may be coupled to rails 102, 104 via an adhesive, such as glue.

Figure 11:
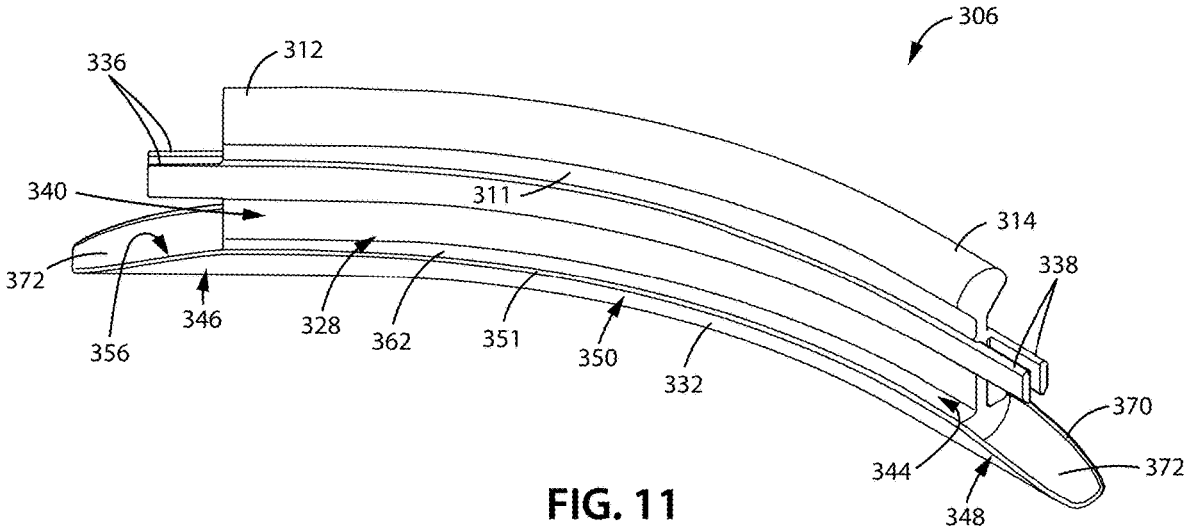
FIG. 11 is a perspective view of a curtain support rail connector, according to another exemplary embodiment.
Figure 12:
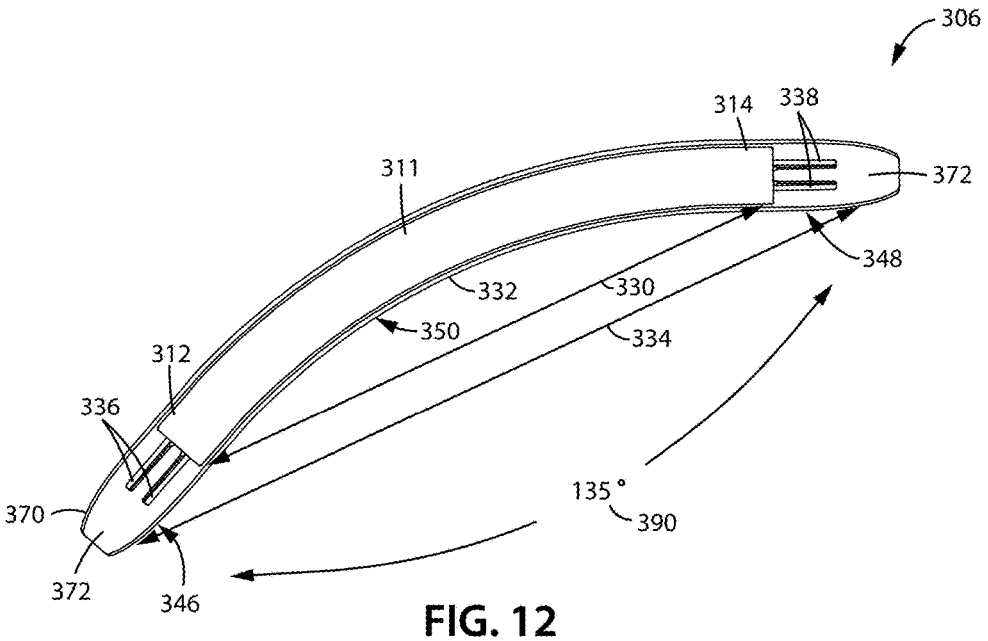
FIG. 12 is a top view of the curtain support rail connector of FIG. 11, according to an exemplary embodiment.

Referring to FIGS. 11-12, a connector 306 is shown. Connector 306 is substantially the same as connectors 106 and 206, except for the differences discussed herein. Specifically, connector 306 is curved such that it defines an angle 390 measured between a first end 312 of connector 306 and a second end 314 of connector 306.

Connector 306 includes first end 312 configured to connect to a curtain support rail such as first rail 102, and second end 314 configured to connect to a curtain support rail, such as second rail 104. Connector 306 includes a ramp 332. Ramp 332 includes a first angled portion 346, a second angled portion 348, and a center portion 350 extending between first angled portion 346 and second angled portion 348. As shown, center portion 350 is curved at angle 390 defined by connector 306 between first end 312 and second end 314. When connector 306 is connected to a first curtain support rail and a second curtain support rail, connector 306 defines angle 390 between a first end of the first curtain support rail and a second end of the second curtain support rail.

When connected to connector 306, slide surfaces, such as slide surfaces 120, 126, of a first curtain support rail and a second curtain support rail are aligned, and the curtain support rails are separated by a gap 328 that has a predefined distance 330. Predefined distance 330 is measured along a line that intersects with connector 306 proximate to first end 312 and intersects with connector 306 proximate to second end 314. Ramp 332 has a length 334 greater than the predefined distance 330. Length 334 is measured between first angled portion 346 and second angled portion 348.

In certain embodiments, angle 390 defined between first end 312 and second end 314 is at least 80 degrees. In other certain embodiments, angle 390 is less than 180 degrees. In other certain embodiments, angle 390 is between 80 degrees and 150 degrees, and more specifically is 135 degrees.

Figure 13:
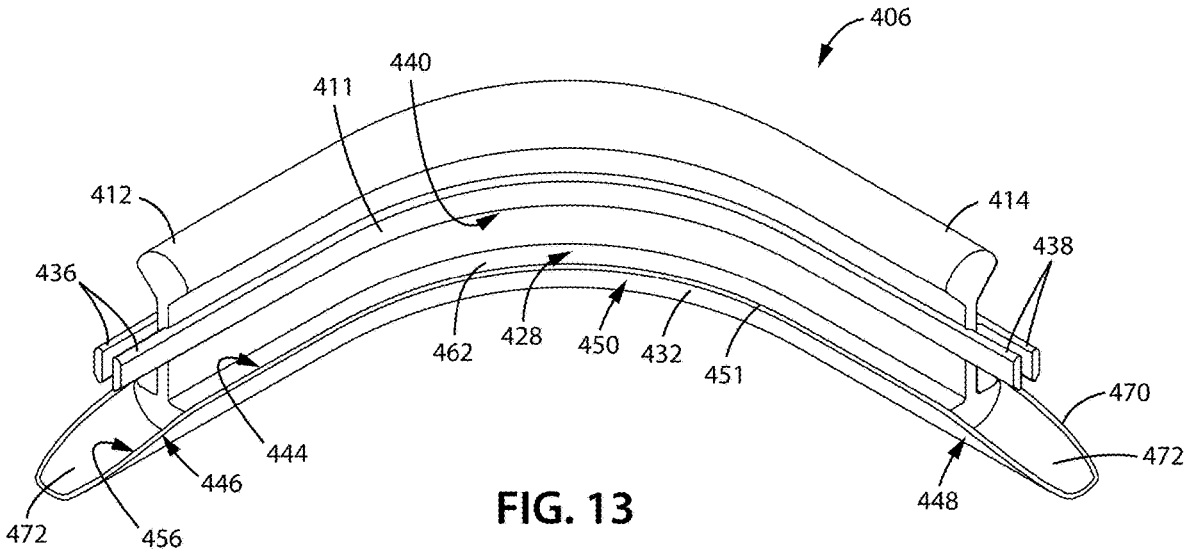
FIG. 13 is a perspective view of a curtain support rail connector, according to another exemplary embodiment.
Figure 14:
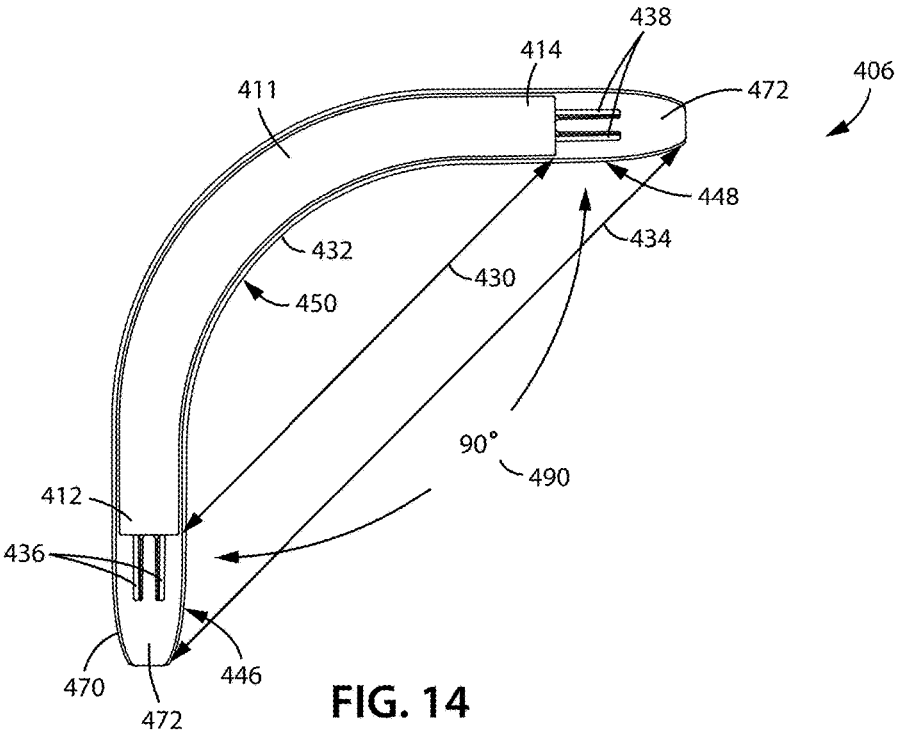
FIG. 14 is a top view of the curtain support rail connector of FIG. 13, according to an exemplary embodiment.

Referring to FIGS. 13-14, a connector 406 is shown. Connector 406 is substantially the same as connector 306, except for the differences discussed herein. Connector 406 defines an angle 490 between a first end 412 and a second end 414 of connector 406. Specifically, angle 490 angle is between 80 degrees and 150 degrees, and more specifically is 90 degrees.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes, and omissions may also be made in the design, operating conditions, and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths, and radii, as shown in the Figures are to scale. Actual measurements of the Figures will disclose relative dimensions, angles, and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A curtain support rail connector for connecting curtain support rails each having first and second ends and each including slide surfaces for supporting a curtain carrier moving along a curtain travel path, the connector comprising:

a first end having at least one flange configured to connect to the first end of a first curtain support rail;

a second end opposite the first end, the second end having at least one flange configured to connect to the second end of a second curtain support rail such that the slide surfaces of the first curtain support rail and the second curtain support rail are aligned and the first end of the first curtain support rail and the second end of the second curtain support rail are separated by a gap having a predefined distance;

a ramp having a length greater than the predefined distance, the ramp including a first angled portion for locating adjacent to the slide surface of the first curtain support rail, a center portion for locating adjacent to the gap, and a second angled portion for locating adjacent to the slide surface of second curtain support rail such that a curtain carrier moving along the curtain travel path from the first curtain support rail to the second curtain support rail is supported by the ramp;

a body extending between the first end and the second end; and a gap surface extending between the body and an inner surface of the ramp, wherein the gap surface, the body, and the inner surface of the ramp define a groove.

2. The curtain support rail connector of claim 1, wherein the center portion is positioned between the first end of the connector and the second end of the connector.

3. The curtain support rail connector of claim 1, wherein an outer edge of the center portion is positioned between a top surface of the connector and a bottom surface of the connector.

4. The curtain support rail connector of claim 1, wherein the center portion has a length less than the predefined distance of the gap.

5. The curtain support rail connector of claim 1, wherein the connector is curved and defines an angle measured between the first end of the connector and the second end of the connector, and wherein the angle is at least 80 degrees.

6. The curtain support rail connector of claim 5, wherein the angle is less than 180 degrees.

7. A curtain support rail connector for connecting curtain support rails, the connector comprising:

a body having a first end, a second end opposite the first end, and a first side surface extending between the first end and the second end;

a first flange extending away from the first end of the body and configured to connect to a first curtain support rail;

a second flange extending away from the second end of the body and configured to connect to a second curtain support rail such that the first curtain support rail and second support rail are separated by a gap having a predefined distance defined by the body when connected to the first end and second end of the body;

a ramp having a length greater than the predefined distance; and a gap surface extending between an inner surface of the ramp and the first side surface of the body such that the gap surface, the inner surface of the ramp, and the first side surface define a groove;

wherein a curtain carrier travels along the groove and is supported by the ramp when the curtain carrier moves between the first curtain support rail and the second curtain support rail.

8. The curtain support rail connector of claim 7, wherein a length of the groove is equal to the predefined distance of the gap.

9. The curtain support rail connector of claim 7, wherein the length of the ramp is greater than a length of the groove.

10. The curtain support rail connector of claim 7, wherein the gap surface extends along a plane perpendicular to the first side surface of the body.

11. The curtain support rail connector of claim 7, wherein the ramp includes a first angled portion for locating adjacent to the first curtain support rail, a center portion for locating adjacent to the gap, and a second angled portion for locating adjacent to the second support rail.

12. A curtain support assembly, comprising:

a first rail including a first slide surface configured to support a curtain carrier;

a second rail including a second slide surface configured to support a curtain carrier; and a connector positioned between the first rail and the second rail, the connector including a first end having a first flange engaged with the first rail, a second end opposite the first end, the second end having a second flange engaged with the second rail, wherein the second end is separated from the first end by a gap defining a predefined distance between the first slide surface and the second slide surface, a body extending between the first end and the second end, and a ramp having a length greater than the predefined distance, the ramp including a first angled portion located adjacent to the first slide surface of the first rail, a second angled portion located adjacent to the second slide surface of the second rail, and a center portion extending between the first angled portion and the second angled portion, the center portion located adjacent to the gap, wherein a gap surface extends between the body and an inner surface of the ramp such that the gap surface, the body, and the inner surface of the ramp define a groove; and wherein the connector is configured such that when a curtain carrier is mounted on the curtain support assembly and moving along a curtain travel path between the first rail and the second rail, the curtain carrier is supported by the ramp.

13. The curtain support assembly of claim 12, wherein the first slide surface of the first rail is aligned with the second slide surface of the second rail.

14. The curtain support assembly of claim 12, wherein the first rail includes a first end and a second end opposite the first end, the first slide surface extending between the first end of the first rail and the second end of the first rail, wherein the first flange is coupled to the first end of the first rail.

15. The curtain support assembly of claim 14, wherein the first angled portion defines an inclined surface extending from the first slide surface proximate to the first end of first rail to the center portion of the ramp.

16. The curtain support assembly of claim 14, wherein the first end of the first rail and the first end of the connector are coupled together via a fastener.

17. The curtain support assembly of claim 14, wherein the first end of the first rail defines an opening, and wherein the first flange is received and retain in the opening.

18. The curtain support assembly of claim 12, wherein the ramp is a first ramp, wherein the connector further includes a first side surface extending between the first end and the second end, a second side surface opposite the first side surface, and a second ramp, wherein the first ramp is located adjacent to the first side surface of the connector and the second ramp is located adjacent to the second side surface of the connector.

19. The curtain support assembly of claim 12, wherein the connector is curved and defines an angle between the first rail and the second rail, and wherein the angle is between 80 degrees and 150 degrees.

20. A curtain support rail connector for connecting curtain support rails each having first and second ends and each including slide surfaces for supporting a curtain carrier moving along a curtain travel path, the connector comprising:

a first end having at least one flange configured to connect to the first end of a first curtain support rail;

a second end opposite the first end, the second end having at least one flange configured to connect to the second end of a second curtain support rail such that the slide surfaces of the first curtain support rail and the second curtain support rail are aligned and the first end of the first curtain support rail and the second end of the second curtain support rail are separated by a gap having a predefined distance; and a ramp having a length greater than the predefined distance, the ramp including a first angled portion for locating adjacent to the slide surface of the first curtain support rail, a center portion for locating adjacent to the gap, and a second angled portion for locating adjacent to the slide surface of second curtain support rail such that a curtain carrier moving along the curtain travel path from the first curtain support rail to the second curtain support rail is supported by the ramp; and wherein the connector is curved and defines an angle measured between the first end of the connector and the second end of the connector, and wherein the angle is at least 80 degrees.

21. The curtain support rail connector of claim 20, wherein the angle is less than 180 degrees.

22. A curtain support assembly, comprising:

a first rail including a first slide surface configured to support a curtain carrier;

a second rail including a second slide surface configured to support a curtain carrier; and a connector positioned between the first rail and the second rail, the connector including:

a first end having a first flange engaged with the first rail;

a second end opposite the first end, the second end having a second flange engaged with the second rail, wherein the second end is separated from the first end by a gap defining a predefined distance between the first slide surface and the second slide surface;

a first side surface extending between the first end and the second end;

a second side surface opposite the first side surface;

a first ramp having a length greater than the predefined distance, the first ramp including a first angled portion located adjacent to the first slide surface of the first rail, a second angled portion located adjacent to the second slide surface of the second rail, and a center portion extending between the first angled portion and the second angled portion, the center portion located adjacent to the gap; and a second ramp, wherein the first ramp is located adjacent to the first side surface of the connector and the second ramp is located adjacent to the second side surface of the connector; and wherein the connector is configured such that when a curtain carrier is mounted on the curtain support assembly and moving along a curtain travel path between the first rail and the second rail, the curtain carrier is supported by the ramp.

23. The curtain support assembly of claim 22, wherein the connector is curved and defines an angle between the first rail and the second rail, and wherein the angle is between 80 degrees and 150 degrees.

* * * * *